US009389011B2

(12) United States Patent
Kim

(10) Patent No.: US 9,389,011 B2
(45) Date of Patent: Jul. 12, 2016

(54) REFRIGERATOR HAVING A SLIDING DOOR

(71) Applicant: KANGTANSANUP CO., LTD., Gyeonggi-do (KR)

(72) Inventor: Woo Ki Kim, Icheon-si (KR)

(73) Assignee: KANGTANSANUP CO., LTD., Hanam-Si (KR)

( * ) Notice: Subject to any disclaimer, the term of this patent is extended or adjusted under 35 U.S.C. 154(b) by 0 days.

(21) Appl. No.: 14/426,935

(22) PCT Filed: Sep. 4, 2013

(86) PCT No.: PCT/KR2013/007959
§ 371 (c)(1),
(2) Date: Mar. 9, 2015

(87) PCT Pub. No.: WO2014/042382
PCT Pub. Date: Mar. 20, 2014

(65) Prior Publication Data

US 2015/0241113 A1 Aug. 27, 2015

(30) Foreign Application Priority Data

Sep. 13, 2012 (KR) ..... 10-2012-0101522

(51) Int. Cl.
*F25D 23/02* (2006.01)
*E05D 7/00* (2006.01)
(Continued)

(52) U.S. Cl.
CPC ..... *F25D 23/021* (2013.01); *E05D 7/00* (2013.01); *E05D 15/0604* (2013.01);
(Continued)

(58) Field of Classification Search
CPC ..... F25D 23/02; F25D 23/021; F25D 23/028; F25D 2323/02; F25D 2323/021; F25D 2323/024; E05D 3/18; Y10T 16/547; Y10T 16/5474; Y10T 16/5475; Y10T 16/5476; Y10T 16/528; Y10T 16/37; Y10T 16/3825; Y10T 16/3828; Y10T 16/3837
USPC ..... 49/246, 247, 248, 249, 250, 252, 253, 49/260, 261
See application file for complete search history.

(56) References Cited

U.S. PATENT DOCUMENTS 845,479 A * 2/1907 Randall ..... 16/103
1,265,952 A * 5/1918 Piper ..... 160/199
(Continued)

FOREIGN PATENT DOCUMENTS

DE 803239 C * 4/1951 ..... F25D 23/02
DE 102009004592 A1 * 7/2009 ..... F25D 23/028
(Continued)

OTHER PUBLICATIONS

International Search report and Written Opinon issued in a corresponding PCT/KR2013/007959 on Oct. 16, 2013.

*Primary Examiner* — Andrew Roersma
(74) *Attorney, Agent, or Firm* — STIP Law Group, LLC

(57) ABSTRACT

The present invention provides a refrigerator having a sliding door, comprising: a refrigerator body which has an opened front part and has a storage space therein; a pair of sliding guide units provided on upper and lower ends of the refrigerator body; a door arranged on the front side of the refrigerator body; and a sliding operation unit which has one end that is coupled so as to allow a sliding movement and a horizontal rotation along each sliding guide unit and the other end that is hingedly coupled to the door, and which is foldable according to a moving direction during the sliding movement such that the door is gradually separated from the front side of the refrigerator body during the sliding movement so as to open the inside of the refrigerator body.

3 Claims, 8 Drawing Sheets

(51) Int. Cl.
*E05D 15/06* (2006.01)
*E05D 15/48* (2006.01)
*E05D 15/58* (2006.01)

(52) U.S. Cl.
CPC ..... *E05D 15/0621* (2013.01); *E05D 15/48* (2013.01); *E05D 15/58* (2013.01); *F25D 23/02* (2013.01); *F25D 23/028* (2013.01); *E05D 2015/485* (2013.01)

(56) References Cited

U.S. PATENT DOCUMENTS

| | | | | | |
|---|---|---|---|---|---|
| 2,557,614 | A * | 6/1951 | Schafer | ..... | 49/212 |
| 3,051,999 | A * | 9/1962 | Schimek | ..... | 49/212 |
| 4,306,377 | A * | 12/1981 | Sterling et al. | ..... | 49/250 |
| 2003/0070363 | A1 * | 4/2003 | Bakalar | ..... | 49/409 |
| 2004/0000028 | A1 * | 1/2004 | Kim | ..... | 16/230 |
| 2006/0218864 | A1 * | 10/2006 | Blomqvist | ..... | 49/248 |
| 2010/0139038 | A1 * | 6/2010 | Busch | ..... | 16/90 |
| 2011/0141672 | A1 * | 6/2011 | Farley et al. | ..... | 361/679.01 |
| 2012/0279130 | A1 * | 11/2012 | Appeldoorn et al. | ..... | 49/252 |

FOREIGN PATENT DOCUMENTS

| | | | | | |
|---|---|---|---|---|---|
| EP | 2482015 | A2 * | 1/2012 | ..... | F25D 23/02 |
| JP | 2002-106242 | | 4/2002 | | |
| JP | 2008057313 | A * | 3/2008 | ..... | F25D 23/02 |
| KR | 10-1993-002357 | B1 | 3/1993 | | |
| KR | 10-2004-0092150 | A | 11/2004 | | |
| KR | 10-2010-0006299 | A | 1/2010 | | |
| KR | 101006127 | B1 * | 12/2010 | ..... | B60P 1/26 |
| KR | 20-0334771 | Y1 | 11/2013 | | |

* cited by examiner

REFRIGERATOR HAVING A SLIDING DOOR

TECHNICAL FIELD

The present disclosure relates to a refrigerator having a sliding door, and more particularly to a refrigerator having a sliding door that can open and close the interior of the refrigerator while minimizing the loss of internal cold air.

BACKGROUND

With the improvement of living standards, refrigerators have become essential home appliances to human life.

In addition to the basic functions of the refrigeration and freezing of the stored food inside, refrigerators in recent times incorporate a dispenser or home bar to refrigerator doors to enhance the convenience of the consumer, and LED display installations on the refrigerator doors lead the way to more luxurious refrigerators.

However, the inventor has yet to find a significant improvement on the structure for opening and closing the refrigerator.

Korean unexamined publication No. 10-2004-0092150 published Nov. 3, 2004 discloses a sliding door of a refrigerator against conventional refrigerators having a refrigerator body installed with a refrigerator compartment door hinged at its right edge and a freezer compartment door hinged at its left edge. Refrigerator doors are typically structured to come into close contact with the refrigerator body as they close the front entrance to the refrigerator body and to rotate about the hinged axes as they open the front entrance.

However, such refrigerator door structures necessitated extra spaces to open the refrigerator doors beyond the basic installation space occupied by the refrigerator body, increasing the overall refrigerator footprint in effect.

In addition, the door structure involves a user to pull the doors to swing open, and therefore the cool air inside of the refrigerator is quickly drawn out to the atmosphere, wasting precious energy. In other words, repeated door operations exhaust most of the cooling energy in the refrigerator.

DISCLOSURE

Technical Problem

Therefore, the present disclosure seeks to provide a refrigerator having at least one sliding door to slide open and close the compartments of the refrigerator for minimizing the cool air loss of the refrigerator.

The present disclosure seeks to provide a refrigerator door which partially opens in a sliding motion followed by a hinge motion into a complete opening of the refrigerator for minimizing the cool air loss of a refrigerator.

SUMMARY

The present disclosure in some embodiments provides a refrigerator having a sliding door, including a refrigerator body having an open front and internally forming a compartment space; a pair of sliding guides installed on the top and bottom of the refrigerator body, at least one door placed in front of the refrigerator body; and at least one sliding actuator. The sliding actuator is configured to have one end connected to each of the sliding guides so as to perform a sliding motion along and a horizontal rotation with respect to said each sliding guide, have the other end hinged to the door, be foldable in accordance with the sliding motion, and open the interior of the refrigerator body by parting the door in the sliding motion gradually from the front of the refrigerator.

The door may have a pair of pivot supports, each being hinged to the other end of the sliding actuator, and the pivot supports may be distally hinged to the top and bottom of the door, respectively.

The door may be internally formed with an insertion groove for receiving the other end of the sliding actuator by a portion hinged to the door.

The slide actuator may include a pair of slider members, each slider member having one end provided with at least one roller rolling horizontally along the sliding guide and the other end hinged distally to each of the pivot supports. The slider members in a pair may have respective one end hinged to opposite ends of a connection bar.

Said each slider member may have a first actuating arm configured to have one end provided with the roller and the other end hinged distally to the connection bar and a second actuating arm extending a predetermined length along a direction perpendicular from the other end of the first actuating arm. The second actuating arm may have one end provided with an insertion groove stopper which is in gearing engagement with the insertion groove, and the first actuating arm and the second actuating arm may have a connection bar therebetween.

The length of the second actuating arm may be greater than the sum of a depth of the door and a depth of an auxiliary compartment formed on the inside of the door.

The sliding guide may be formed with a guide hole for accommodating and guiding the roller to roll along horizontally, the guide hole may be provided rearwardly with a pair of roller escape grooves or roller bays, and the guide hole may be provided forwardly with a cut-off hole for guiding said each slider member to be movable along the horizontal direction. The sliding guide may have a guide body including at least one connection bar stopper installed inside of the guide hole on a top surface or a bottom surface thereof or on both top and bottom surfaces.

Advantageous Effects

The present disclosure effectively minimizes the cool air loss of the refrigerator by providing a sliding door to slide open and close the compartments of the refrigerator.

The present disclosure effectively minimizes the cool air loss of the refrigerator by providing a door which partially opens in a slide motion followed by a hinge motion into a complete opening of the refrigerator.

The present disclosure provides the user with a slide open door arrangement just to permit an access to foods in the refrigerator and freezer compartments and enables the user to access foods in the door compartments through the initial slide opening of the door completed by a further hinged open motion through a hinged arrangement at a lower lateral edge of the door.

Further, the present disclosure increases the efficiency of the cold storage with the quicker slide opening of the door to make up for the longer opening duration to access the refrigerated foods compared to the time to take a beverage bottle out of the door compartment, while the door in the hinged open mode alternatively allows a complete extended access to all of the available compartments.

BEST MODES FOR CARRYING OUT THE INVENTION

Hereinafter, a sliding door refrigerator according at least one embodiment of the present disclosure will be described in detail with reference to the accompanying drawings.

A configuration of the refrigerator will be described first.

Figure 1:
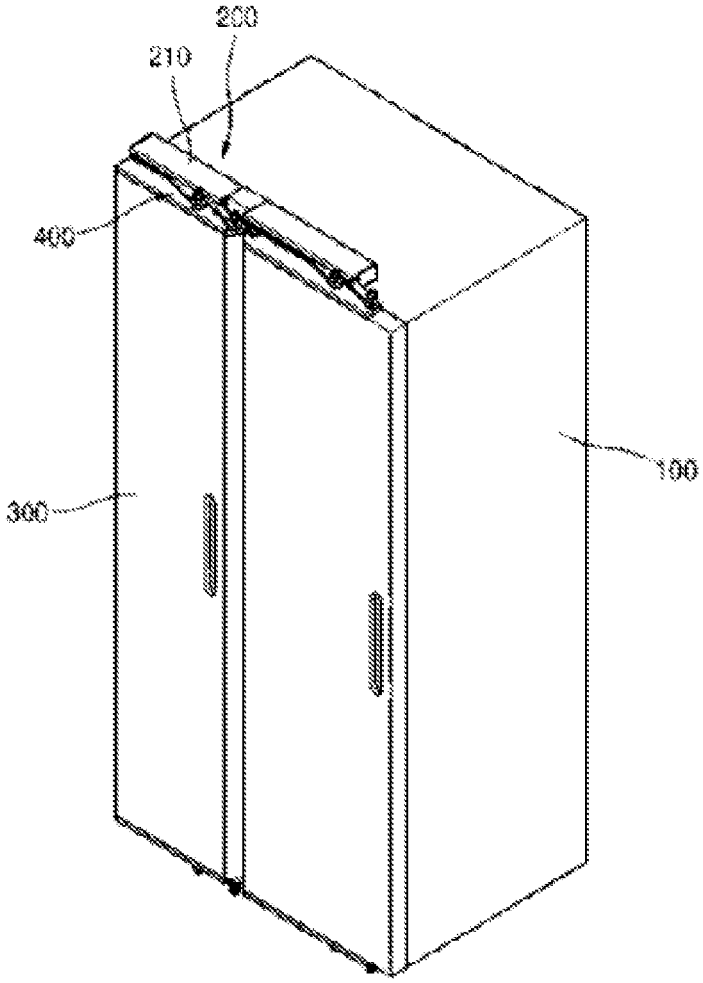
FIG. 1 is a perspective view of a refrigerator having at least one sliding door according to at least one embodiment of the present disclosure.
Figure 2:
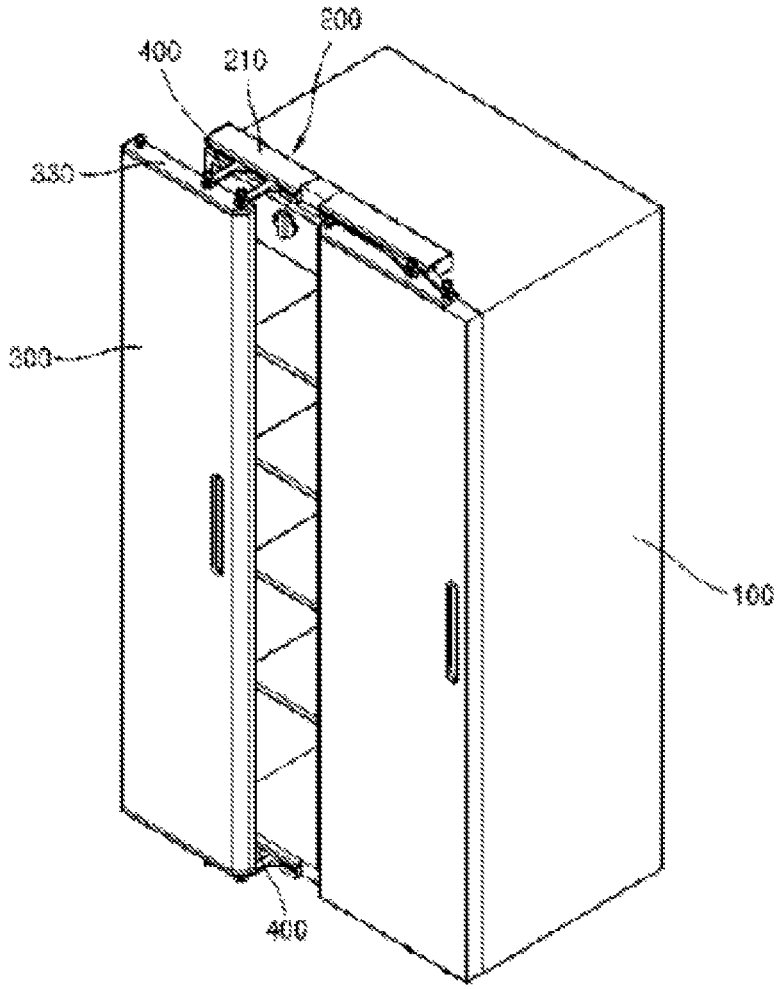
FIG. 2 is a perspective view of the refrigerator of FIG. 1 having one side door in a first open stage.
Figure 3:
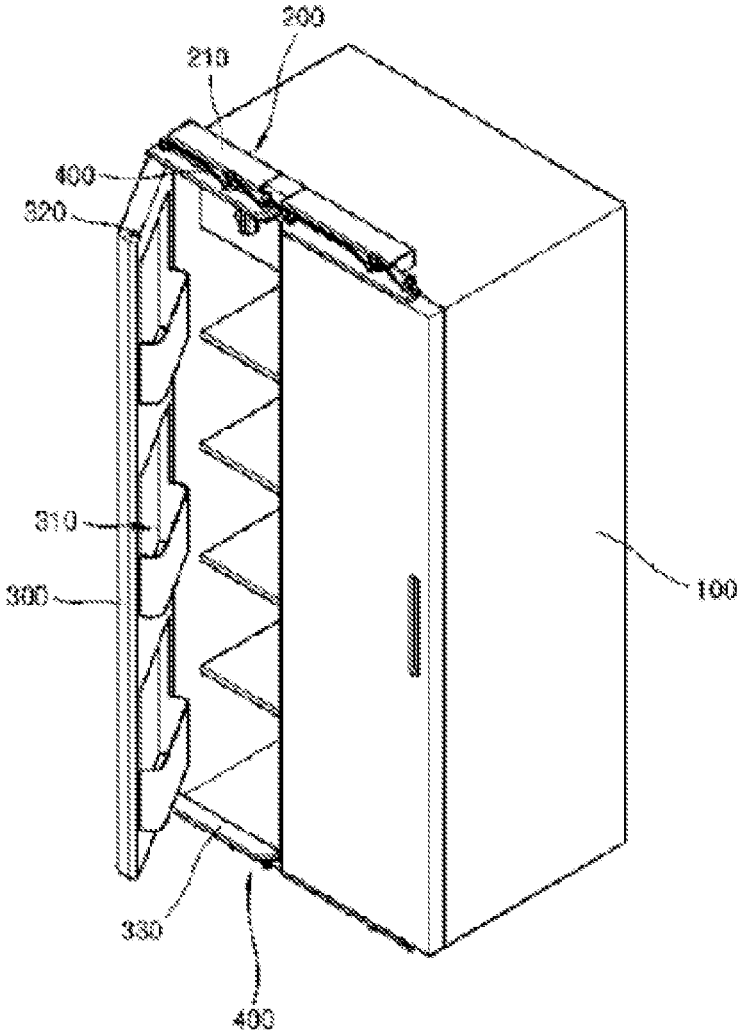
FIG. 3 is a perspective view of the side door hinged open following the state of FIG. 2 after slide opening the side door to the fullest.
Figure 4:
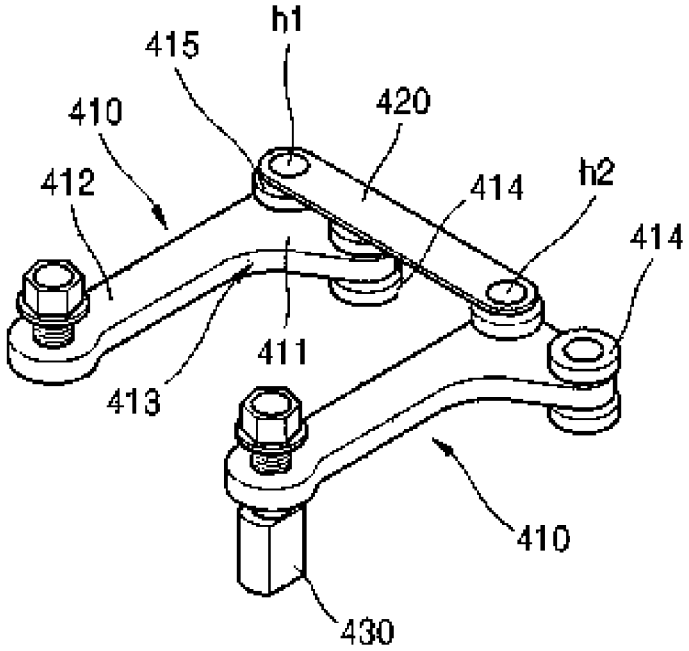
FIG. 4 is a perspective view of a sliding actuator according to at least one embodiment of the present disclosure.
Figure 5A:
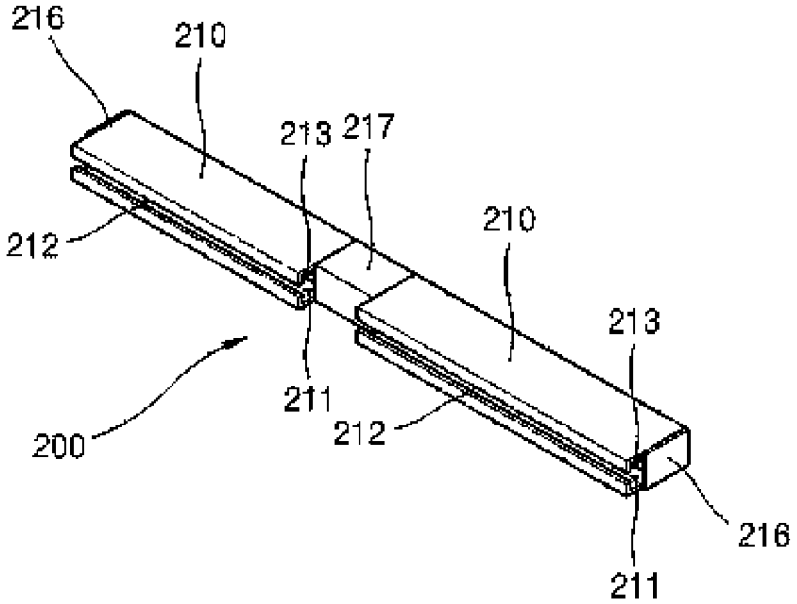
FIGS. 5A and 5B are perspective views of a sliding guide according to at least one embodiment of the present disclosure.
Figure 5B:
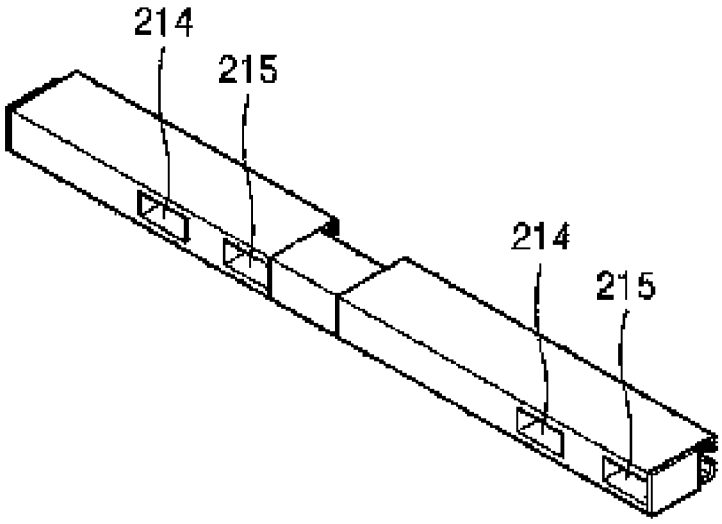
Figure 6:
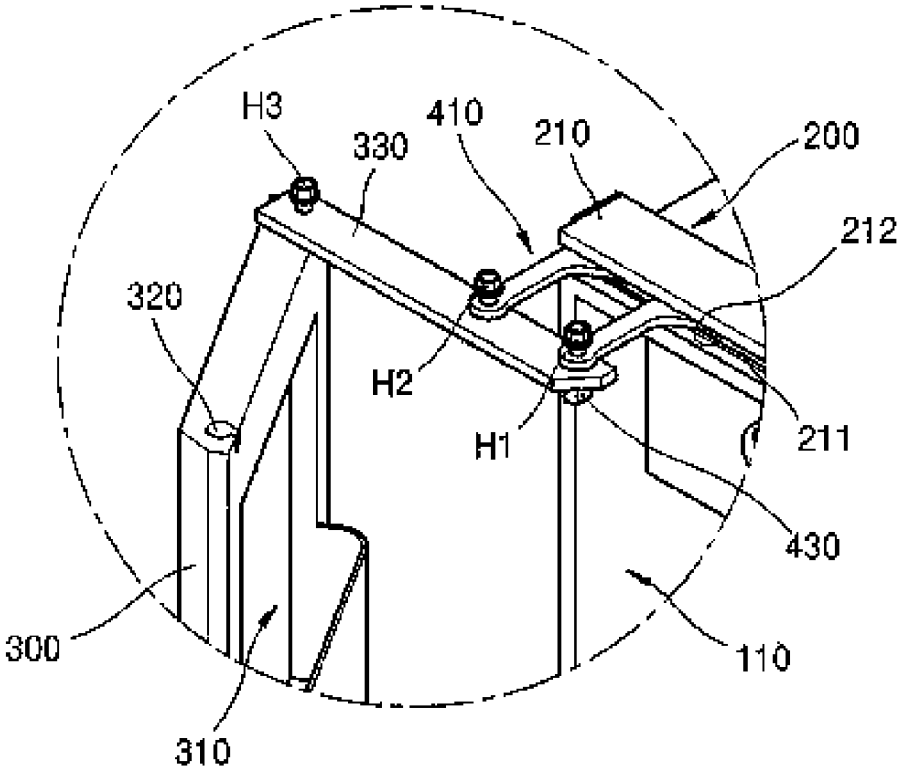
FIG. 6 is an enlarged perspective view of the operation of the side door of FIG. 3.

FIG. 1 shows a refrigerator with its doors closed, and FIG. 2 shows a state where one side door is in a first open stage. FIG. 3 shows the side door hinged open to the fullest. FIG. 4 shows a sliding actuator according to at least one embodiment of the present disclosure. FIGS. 5A and 5B illustrate a sliding guide according to at least one embodiment of the present disclosure.

Referring to FIGS. 1 through 5B, the sliding door refrigerator the present disclosure generally includes a refrigerator body 100, a pair of doors 300, a sliding guide 200 and a pair of sliding actuators 400 coupled to the pair of doors 300.

The refrigerator body 100 includes at least one food storage or compartment 110 with its front side opened.

The two doors 300 are respectively provided at their inner sides with auxiliary storages or compartments 310.

The doors 300 are disposed in parallel frontally of the refrigerator body 100.

The refrigerator body 100 has a top and a bottom respectively installed with a pair of sliding guides 200. Two sliding guides 200 are disposed so as to conform to the top and bottom of each door 300. Therefore, when a refrigerator is configured to have two doors 300, two pairs of sliding guides 200 are provided.

Here, the pair of sliding actuators 400 is adapted to couple the top and bottom of each door 300 respectively to the sliding guide 200 for permit the door 300 to slide open and close and further pivot open and close. In other words, each door 300 is connected by each pair of sliding actuators 400 to the top and bottom of the refrigerator body 100.

The following is a more detailed explanation on the above-mentioned construction. This embodiment illustrates a case with two doors 300 which have an identical opening and closing mechanism and the description will be given for the illustrative arrangement of one door 300.

The top and bottom of the refrigerator body 100 are respectively installed with the pair of sliding guides 200.

The sliding guide 200 on top of the refrigerator body 100 is formed by at least one guide body 210 having a predetermined length.

The front surface of the guide body 210 includes an incision hole 212 formed along the longitudinal direction thereof and a guide hole 211 formed internally of the incision hole 212. The cut-off hole 212 is formed to face the front of the refrigerator body 100.

The guide hole 211 is provided at its rear side with regularly spaced roller escape grooves or bays 214, 215 having a predetermined size.

The guide hole 211 is also provided at its inner upper surface with a connection bar stopper 213. Further, the connection bar stopper 213 can also be installed inside of the guide hole 211 on its top surface or bottom surface or on both top and bottom surfaces. The connection bar stopper 213 is formed in a plate shape having a constant thickness.

Although not shown in the drawings, the outer periphery of the connection bar stopper 213 may have an elastic coating (not shown) for absorbing shocks generated when stopping the sliding actuator 400 by their rollers 414.

The function, position and size of the connection bar stopper 213 will become clear from the illustration of FIG. 7 and more detailed description is incorporated in the description of the operation below.

The sliding guide 200 which is installed on the bottom side of the refrigerator body 100 is the same as the above configuration.

Therefore, the upper and lower ends of the refrigerator body 100 may be respectively installed with the sliding guides 200.

In addition, the sliding actuators 400 are connected in pairs corresponding to the sliding guides 200, respectively.

Referring to FIG. 4, each sliding actuator 400 includes a first actuating arm 411 having a roller 414 is installed on one end, and a second actuating arm 412 extended by a predetermined length to be perpendicular from the first actuating arm 411.

The roller 414 is installed inside the guide hole 211 of the sliding guide 200 and maintains to be movable while rolling horizontally along the inner side walls of the guide hole 211.

On one end of the first actuating arm 411, roller 414 can be a configured to horizontally rotate, and the second actuating arm 412 on the other hand protrudes through the cut-off hole 212 to the front side of the refrigerator body 100.

Here, the sliding guide 200 on top of the refrigerator body 100 is installed with at least one pair of the sliding actuators 400 each configured as described above.

Thus, two second actuating arms 412 protrude out of the sliding guide 200.

In each sliding actuator 400, the first and second actuating arms 411, 412 are interconnected by a support 413.

The support 413 is a member having a predetermined area and rigidity as it connects the first and second actuating arms 411, 412 subject to an external force exerted when opening and closing the door 300 so that the first and second actuating arms 411, 412 are interlocked with each other while they are reinforced against damaging impacts.

Further, two twin ends of sliding actuator 400, that is, the proximal ends of the two first actuating arms 411 are connected to a connection bar 420 having a predetermined length at its opposite ends by hinges h1 and h2.

The connection bar 420 may be on top of the two first actuating arms 411 for establishing the hinged interconnection. Alternatively, two connection bars 420 may be mounted respectively on the upper sides and lower sides of the two first actuating arms 411 in the hinged engagement.

Therefore, the two first and second actuating arms 411, 412 may be interlocked with the opposite ends of the single or two connection bars 420 about the hinges h1, h2. The at least one connection bar 420 is disposed inside the guide hole 211 of the guide body 210.

In addition, the distal ends of the two second actuating arms 412, which protrude to the outside of the sliding guide 200, are hinged to a pivot support 330 having a predetermined length. Thus, the distal ends of the two second actuating arm 412 form two hinged joints (H1, H2) on the pivot support 330.

Of the two hinged joints (H1, H2), the peripheral hinged joint H1 is installed on its underside with an insertion groove stopper 430 which is configured to be inserted in an insertion groove 320 formed on the top inner side of the door 300.

The pivot support 330 may be disposed on top of the door 300, and it has an end portion which forms a hinged joint H3 with an upper end of the door 300.

The refrigerator body 100 also has its bottom sliding guide 200 fitted with paired sliding actuators 400 as described above, which are hingedly coupled to the pivot support 330 positioned at the bottom side of the door 300. Then, the bottom pivot support 330 is hingedly coupled to the bottom of the door 300.

In other words, the configurations and interconnections of the top sliding guide 200, door 300 and the pair of sliding actuators 400 on the upper side of the refrigerator body 100 are same as those on the lower side of the refrigerator body 100.

Here, the length of the second actuating arm 412 of the sliding actuator 400 described above is greater than the sum of the depth of the door 300 and the depth of the auxiliary compartment 310. Configuration and effects thereof will be described later.

The following explains the operation of the sliding door refrigerator of the present disclosure having the above configuration.

As a representative example, the process described is for opening the door 300 in its closed position.

As shown in FIG. 1, disposed in front of the refrigerator body 100, the door 300 holds a sealed state of the internal compartment 110 of the refrigerator body 100.

Here, the sliding actuators 400 on the upper and lower sides of the refrigerator body 100 are in the folded state. Specifically, the rollers 414 of each sliding actuator 400 are located within the roller bays 214, 215 formed on the rear side of the guide hole 211 of the sliding guide 200 as the first and second actuating arms 411, 412 are in a tilted state at a predetermined angle. This will become clear with reference to the right side on FIG. 7, which is the internal perspective view of the sliding guide for the refrigerating compartment. Then, the insertion groove 320 and the stopper 430 assume a first operative state at (a) in FIG. 8, where the door 300 is fixed against a hinged movement to resist that way of opening attempt.

In this state, referring to FIGS. 2 to 7, when an external force pulls the door 300 forwards, the rollers 414 of each sliding actuator 400 make circular motions about the axes of the hinges h1, h2 respectively as the rollers 414 start to disengage from their roller bays formed on the rear side of the guide hole 211 of the sliding guide 200 until they abut the forward side of the guide hole, which causes the rollers 414 to unfold until the second actuating arms 412 come to lie perpendicular to the front side of the refrigerator. In this case, the refrigerator door 300 and its hinge member, i.e. pivot support 330 perform a rotary motion in unison, departing from but in parallel with the front side of the refrigerator body before reaching a first open stage.

FIG. 2 shows the degree of opening in this stage. Then, the insertion groove 320 and the stopper 430 reach a third operative state at (c) in FIG. 8, where the door 300 may start to make an additional hinged movement to open and close thereof. In this case, the second actuating arm 412 is safely made to be longer than the combined depth of the door 300 and the auxiliary compartment 310 so that a horizontal rotary motion of the door 300 does not cause any interference between the auxiliary compartment 310 and the compartment space 110.

When an external force pushes the door 300 towards one lateral side, the rollers 414, 415 of each sliding actuator 400 slide and roll along one side of the guide hole 211 of the sliding guide 200 in the horizontal direction. In this case, the pair of sliding actuators 400 in each sliding guide 200 will be moved simultaneously with their hinged joint maintained by the connection bar 420. The horizontal movement can be carried out until the roller 415 comes into abutment with the slide stopper 216 of FIG. 5.

Specifically, in the opening session, the door 300 starts to operate by gradually departing from the front side of the refrigerator body 100 and then moving along the horizontal direction into an open position lying in parallel to the front side of the refrigerator body 100 to thereby provide a controlled stepwise opening process of the internal compartment 110 of the refrigerator body 100. This eliminates a sweeping loss of cold air from the refrigerator due to an abrupt suction by the opening door 300.

The aforementioned horizontal sliding of the door 300 along with the gradual pulling manipulation off the front side of the refrigerator body 100 may be dedicated as a step for accessing the internal compartment 110 of the refrigerator body 100.

When a user desires to reach the auxiliary compartment 310 formed on the inner side of the door 300, the door 300 yields to swing open in the forward direction.

This is implemented by providing the top and bottom of the door 300 with the hinged joints H3 formed peripherally on the pivot supports 330, respectively.

At this time, the respective pivot supports 330 are in folded state on the top and bottom sides of the door 300, as well as have the insertion groove stoppers 430 provided distally on the peripheral hinged joints H1 of the second actuating arms 412 of the respective sliding actuators 400 maintained within the insertion grooves 320 formed on the top and bottom inner sides of the door 300.

From there, pulling the door 300 forward will break the insertion groove stoppers 430 provided distally on the peripheral hinged joints H1 of the second actuating arms 412 of the respective sliding actuators 400 loose from their cancelled engagements with the insertion grooves 320 formed on the top and bottom inner sides of the door 300. This permits the door 300 to swing forwards about the axis of rotation that is hinged joints thereof with the pivot supports 330, as illustrated in FIG. 3.

Although not depicted in the drawings, the respective pivot supports 330 may be made to have hinged engaged engagements with folding members (not shown) including two or more folds on the top and bottom sides of the door 300. These folding members can also serve to support the load of the door 300 during its opening forwards or closing back.

The following explains the procedure of closing the refrigerator door.

Figure 7:
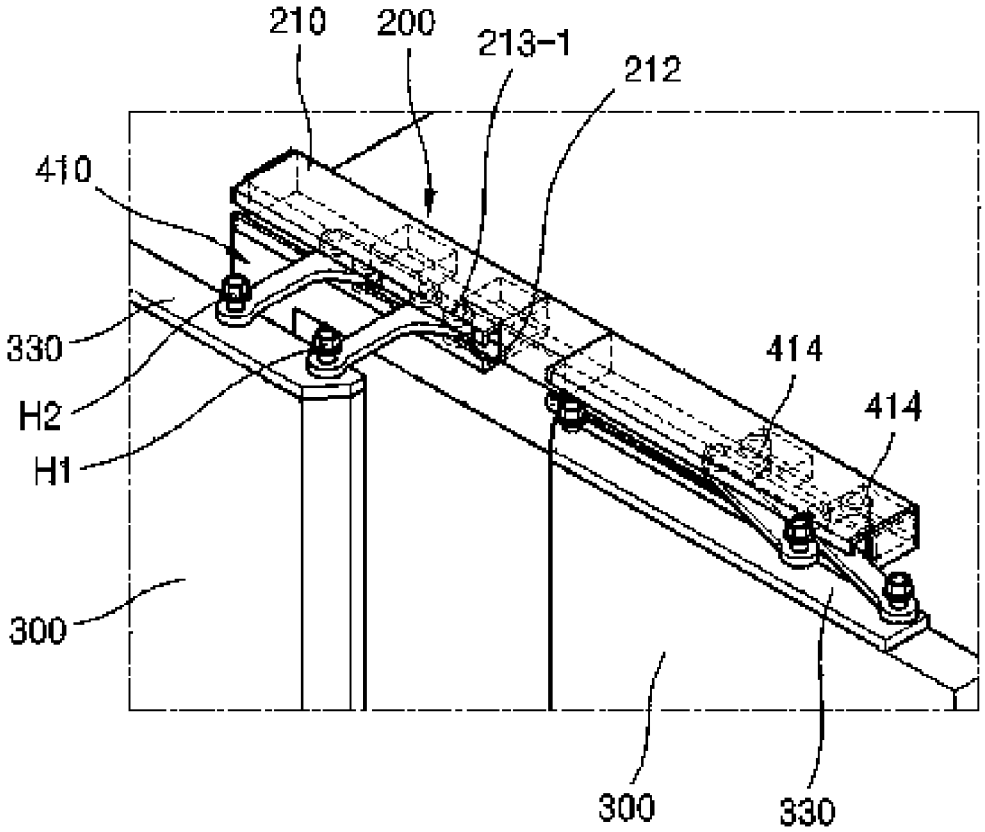
FIG. 7 is a perspective view of a roller in operative relation with a guide hole of the sliding guide according to at least one embodiment of the present disclosure.

Referring to FIG. 7, the door 300, at the end of the swing open session for giving access to the integral auxiliary compartment 310, takes the reverse course of the swing open process back to the closed position, and more complete description will be omitted.

From the slide open position, the refrigerator door 300 may be forced backward into the closed position, when an edge (external to hinge h1) of the connection bar 420 for connecting slider members 410, each constituted by the actuating arms 411, 412 and the support 413, comes into contact with a stopper groove (at 231-1 in FIG. 7) of the connection bar stopper 213 so as to stop the sliding actuator 400 from making any further horizontal movement and therefore the rollers 414 distally mounted on the first actuating arms 411 rotate around the axes of the hinges h1, h2, thrusting into the roller bays 214, 215, respectively.

Accordingly, the second actuating arms 412 follow suit to rotate for leading the interlocked (at hinged joints H1, H2) pivot support 330 and door 330 into a close contact with the refrigerator body 100 to complete the door closing process.

Figure 8:
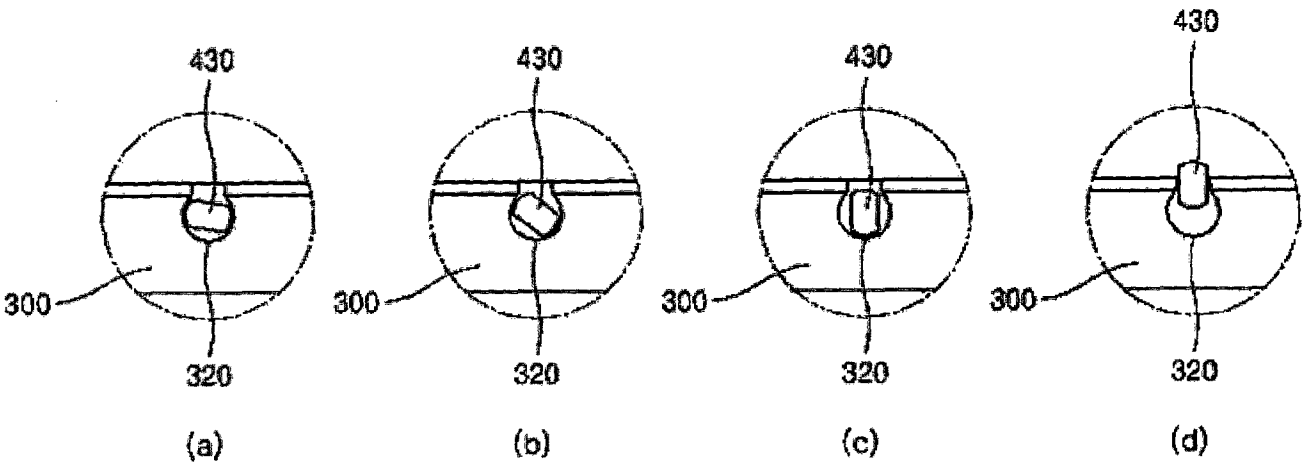
FIG. 8 is views of an insertion groove in relation to a stopper in different stages of the opening and closing operation of the refrigerator door according to at least one embodiment of the present disclosure.

The operative state of the insertion groove 320 and the stopper 430 turns from state (c) to (a) in FIG. 8.

Figure 9:
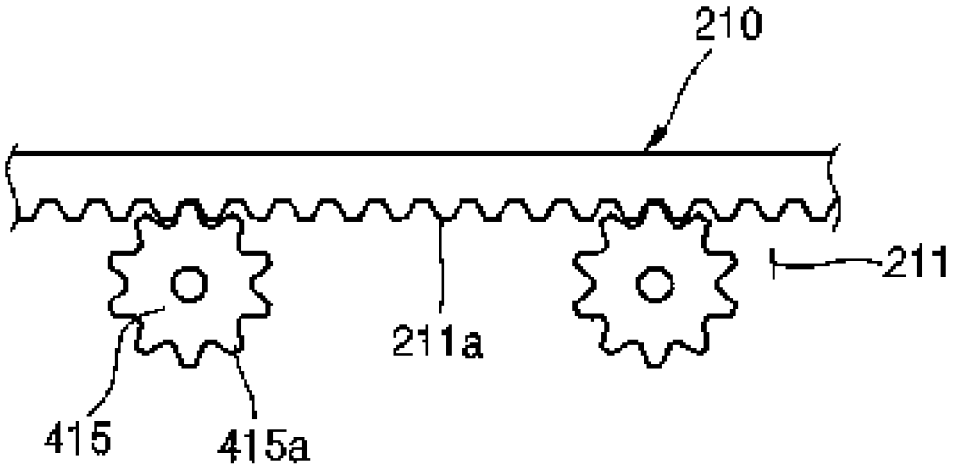
FIG. 9 is a view of the roller in mesh with the sliding guide at the guide hole according to at least one embodiment of the present disclosure.

FIG. 9 shows the rollers in gear mesh within the guide hole of the sliding guide according to the present disclosure.

On the other hand, referring to FIG. 9, the guide hole 211 according to the present disclosure has on its inner surface gear tooth 211*a*, and the rollers 415 are circumferentially formed with gears 415 to be in mesh with the gear tooth 211*a* so that the rollers 415 cam make uniform movements. This prevents the rollers 415 from slipping as they travel within the guide hole 211.

The rollers 415 according to the present disclosure is responsive to the slide opening of the door 300 for traveling substantially along the guide hole 211 of the sliding guide 200, wherein the gear tooth 211*a* for the intermeshing arrangement between the rollers 415 and the guide hole 211 leads to stable operations of the rollers 415.

The controlled stable movement of the rollers 415 as described above can effectively prevent vibrations possibly generated when actually operating the door 300 in the sliding mode.

Figure 10:
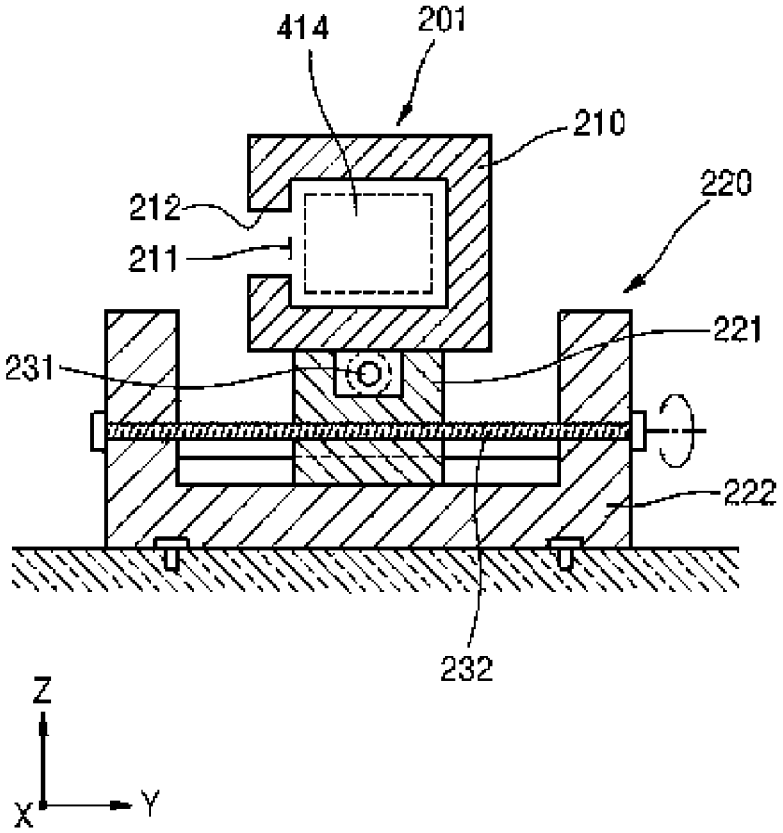
FIG. 10 is a cross sectional view of a sliding guide according to another embodiment of the present disclosure.

FIG. 10 shows another embodiment of a sliding guide according to the present disclosure.

Referring to FIG. 10, a sliding guide 201 according to the present disclosure may further have a slack adjustment member 220 for adjusting the clearance of the guide body 210 two-dimensionally.

The slack adjustment member 220 may include a first and second rail blocks 221, 222 and a first and second ball screws 231, 232.

The first rail block 221 guides the bottom of the guide body 210 for along the X direction. The second rail block 222 guides the first rail block 221 in the Y direction.

In addition, the first ball screw 231 has its opposite ends screw fastened to the opposite side walls of the second rail blocks 222 and it is also screw fastened to the bottom of the guide body 210 so as to translate bidirectional screw motions to linear displacements of the guide body 210 in the X direction.

Further, the second ball screw 232 has its opposite ends screw fastened to the remaining opposite side walls of the second rail blocks 222 and it is also screw fastened to the first rail block 221 so as to translate bidirectional screw motions to linear displacements of the guide body 210 in the Y direction.

Here, each second rail block 222 is installed at the top and bottom of the refrigerator body 100.

In the present disclosure, if opening and closing the door 300 in the sliding mode as described above caused the front side of the refrigerator body 100 and the door 300 to leave a gap therebetween, it can be compensated for by varying the fixed location of at least one guide body 210 on the top and/or bottom side of the refrigerator body 100.

Accordingly, the present disclosure can positively prevent the door 300 from losing cool air due to insufficient sealing operation of the door 300 and eliminate a concern for damage from repetitive sliding operations of the door 300 in an imbalanced posture.

On the other hand, although not shown in the drawings, the present disclosure can further comprise a repositioning means.

The repositioning means may include a first and second motors and a controller.

The first motor is adapted to rotate the first ball screw, and the second motor rotates the second ball screw.

The controller controls to drive the first and second motors. The controller has initial information set up therein.

The initial information includes the position coordinates of the first and second rail blocks, when the first door is arranged to seal the front of the refrigerator body wherein the first and second motors assume their initial states.

Therefore, the controller detects whether the closed door leaves a gap against the front surface of refrigerator body, causing the first and second rail blocks to deviate from their initial position coordinates with certain loads applied to the first and second motors.

In response, the controller can drive the first and second motors for causing the first and second rail blocks to reach the initial position coordinates, and thereby readily restores the sealed engagement between the door and the front surface of the refrigerator body to the original setting.

BEST MODES FOR CARRYING OUT THE INVENTION

100: refrigerator body
110: compartment space
200: sliding guide
210: guide body
211: guide hole
212: cut-off hole
213: connection bar stopper
213-1: stopper groove
214, 215: roller bay
216: slide stopper
300: door
310: auxiliary compartment
320: insertion groove
330: pivot support
400: sliding actuator
410: slider member
411: first actuating arm
412: second actuating arm
413: support
414,415: roller
420: connection bar
430: insertion groove stopper

The invention claimed is:

1. A refrigerator having a sliding door, comprising:

a refrigerator body having an open front and internally forming a compartment space;

a pair of sliding guides installed on the top and bottom of the refrigerator body, at least one door placed in front of the refrigerator body; and at least one sliding actuator configured to have one end connected to each of the sliding guides so as to perform a sliding motion along and a horizontal rotation with respect to said each sliding guide, have the other end hinged to the door, be foldable in accordance with the sliding motion, and open the interior of the refrigerator body by parting the door in the sliding motion gradually from the front of the refrigerator, wherein the door has a pair of pivot supports, each being hinged to the other end of the sliding actuator, and the pivot supports are hinged distally to the top and bottom of the door, respectively, wherein the door is internally formed with an insertion groove for receiving the other end of the sliding actuator by a portion hinged to the door, wherein the slide actuator includes a pair of slider members, each slider member having one end provided with at least one roller rolling horizontally along the sliding guide and the other end hinged distally to each of the pivot supports, wherein the slider members in a pair have respective one end hinged to opposite ends of a connection bar, wherein said each slider member has a first actuating arm configured to have one end provided with the roller and the other end hinged distally to the connection bar and a second actuating arm extending a predetermined length along a direction perpendicular from the other end of the first actuating arm, wherein the second actuating arm has one end provided with an insertion groove stopper which is in gearing engagement with the insertion groove, and wherein the first actuating arm and the second actuating arm have a connection bar therebetween.

2. The refrigerator with the sliding door of claim 1, wherein the length of the second actuating arm is greater than the sum of a depth of the door and a depth of an auxiliary compartment formed on the inside of the door.

3. The refrigerator with the sliding door of claim 1, wherein the sliding guide is formed with a guide hole for accommodating and guiding the roller to roll along horizontally, the guide hole is provided rearwardly with a pair of roller escape grooves, and the guide hole is provided forwardly with a cut-off hole for guiding said each slider member to be movable along the horizontal direction, and wherein the sliding guide has a guide body including at least one connection bar stopper installed inside of the guide hole on a top surface or a bottom surface thereof or on both top and bottom surfaces.

* * * * *